US006557649B1

(12) United States Patent
Yang et al.

(10) Patent No.: US 6,557,649 B1
(45) Date of Patent: May 6, 2003

(54) PNEUMATIC TOOL STRUCTURE

(76) Inventors: Shu Yi Yang, No. 28, Lane 75, Sec. 1, Ta Ching Street, Taichung (TW); Hui Ping Long, 5F-11, No. 50, Sec. 2, Li Ming Road, Taichung (TW)

( * ) Notice: Subject to any disclaimer, the term of this patent is extended or adjusted under 35 U.S.C. 154(b) by 0 days.

(21) Appl. No.: 09/998,190

(22) Filed: Dec. 3, 2001

(51) Int. Cl.[7] ..... B25F 5/00

(52) U.S. Cl. ..... 173/171; 173/213; 173/216; 173/217; 173/218; 173/219

(58) Field of Search ..... 173/213, 216, 173/217, 171, 218, 219

(56) References Cited

U.S. PATENT DOCUMENTS 3,759,336 A * 9/1973 Marcovitz et al. ..... 173/170
3,901,098 A * 8/1975 Jinkins ..... 173/216
3,908,139 A * 9/1975 Duncan, Jr. ..... 173/217
4,416,338 A * 11/1983 Nelson et al. ..... 173/169
4,715,203 A * 12/1987 Wiegenstein ..... 173/169
5,203,417 A * 4/1993 Glaser ..... 173/132
5,419,403 A * 5/1995 Klemm ..... 173/115
6,044,917 A * 4/2000 Brunhoelzl ..... 173/168
6,082,468 A * 7/2000 Pusateri et al. ..... 173/162.2
6,149,356 A * 11/2000 Chu et al. ..... 173/169

* cited by examiner

*Primary Examiner*—Rinaldi I. Rada
*Assistant Examiner*—Brian Nash
(74) *Attorney, Agent, or Firm*—Rosenberg, Klein & Lee

(57) ABSTRACT

A pneumatic tool structure including a main body integrally having an elbow. A pneumatic motor, a switch unit and an intake unit are disposed in the main body. A driving unit is disposed in the elbow. The elbow has a top section formed with an opening corresponding to the main body. The pneumatic motor is placed into the main body from upper side through the opening. A cover is disposed on the elbow for closing/opening the opening.

4 Claims, 11 Drawing Sheets

PNEUMATIC TOOL STRUCTURE

BACKGROUND OF THE INVENTION

The present invention is related to a pneumatic tool structure including a main body integrally having an elbow. The elbow has a top section formed with an opening. The pneumatic motor is placed into the main body through the opening and fixed in the main body. The installation of the pneumatic motor is easy and the test is facilitated.

FIGS. 7 to 9 show a conventional pneumatic tool having a main body 7. A switch unit 71 and an intake unit 72 are arranged on lower section of the main body 7. A pneumatic motor 73 is disposed in the upper section of the main body 7 and fixed by a fitting ring 74. A driving unit 77 is disposed in an elbow 75 and coupled with a bit such as a sand disc. The bottom of the elbow 75 has a coupling section 751. A retainer ring 76 is screwed on the coupling section 751 and the fitting ring 74 to fix the elbow 75 with the main body 7.

When assembled, the switch unit 71 and the intake unit 72 are first mounted into the lower section of the main body 7. Then, the pneumatic motor 73 is installed into the upper section of the main body 7. Then a test is performed to check the cooperation and operation of the pneumatic motor 73, switch unit 71 and the intake unit 72. In case of problem, it is necessary to disassemble the pneumatic motor 73, switch unit 71 and the intake unit 72 for further test. After passing through the test, the elbow 75 is assembled with the main body 7 by means of the retainer ring 76 screwed on the fitting ring 74. When screwing the retainer ring 76, it is necessary to carefully check the direction of the elbow 75 so as to avoid deflection of the elbow 75. Such procedure is troublesome and time-consuming.

In use of the pneumatic tool, the bit is laterally pressed against a work piece by a considerably great force. In operation, the retainer ring 76 suffers the vibration and the lateral force and is likely to loosen. As a result, the elbow 75 is apt to swing. This is very dangerous to the operator.

FIGS. 10 and 11 show an improved conventional pneumatic tool the main body 8 of which integrally has an elbow 81. A pneumatic motor 82, a switch unit 83 and an intake unit 84 are respectively mounted in lower side and lateral side of the main body 8. A driving unit 85 is installed in the elbow 81.

According to the above arrangement, the elbow 81 is integrally connected with the main body 8 and is thus prevented from loosening due to lateral force. However, when assembled, the pneumatic motor 82 is first installed into the main body 8 and then the switch unit 83 is mounted into the main body 8 from lateral side thereof to stop and fix the pneumatic motor 82. The switch unit 83 must tightly fitted with the pneumatic motor 82. Otherwise, the pneumatic motor 82 can be hardly firmly fixed and a leakage may take place during operation. The tight fit design makes it difficult to mount the switch unit 83. When assembling the switch unit 83, on one hand, it is necessary to tightly press the pneumatic motor 82, with a tool and on the other hand, the switch unit 83 must be at the same time installed in. In case of untrue cooperation, it will be impossible to complete the assembly. After the pneumatic motor 82 and the switch unit 83 are assembled, the intake unit 84 is assembled. Thereafter, a test is performed. In case that a problem is found in the test, it is necessary to disassemble all of the pneumatic motor 82, the switch unit 83 and the intake unit 84 to separately test and solve the problem. After the problem is solved, it is necessary to again tightly fit the switch unit 83 with the pneumatic motor. Such procedure is complicated and troublesome.

SUMMARY OF THE INVENTION

It is therefore a primary object of the present invention to provide a pneumatic tool structure including a main body integrally having an elbow. A pneumatic motor, a switch unit and an intake unit are disposed in the main body. The top section of the elbow is formed with the opening corresponding to the main body. After the switch unit and the intake unit are installed into the main body, the pneumatic motor is placed into the main body from the opening. The installation of the pneumatic motor is easy and the test is facilitated.

The present invention can be best understood through the following description and accompanying drawings wherein:

DESCRIPTION OF THE PREFERRED EMBODIMENTS

Figure 1:
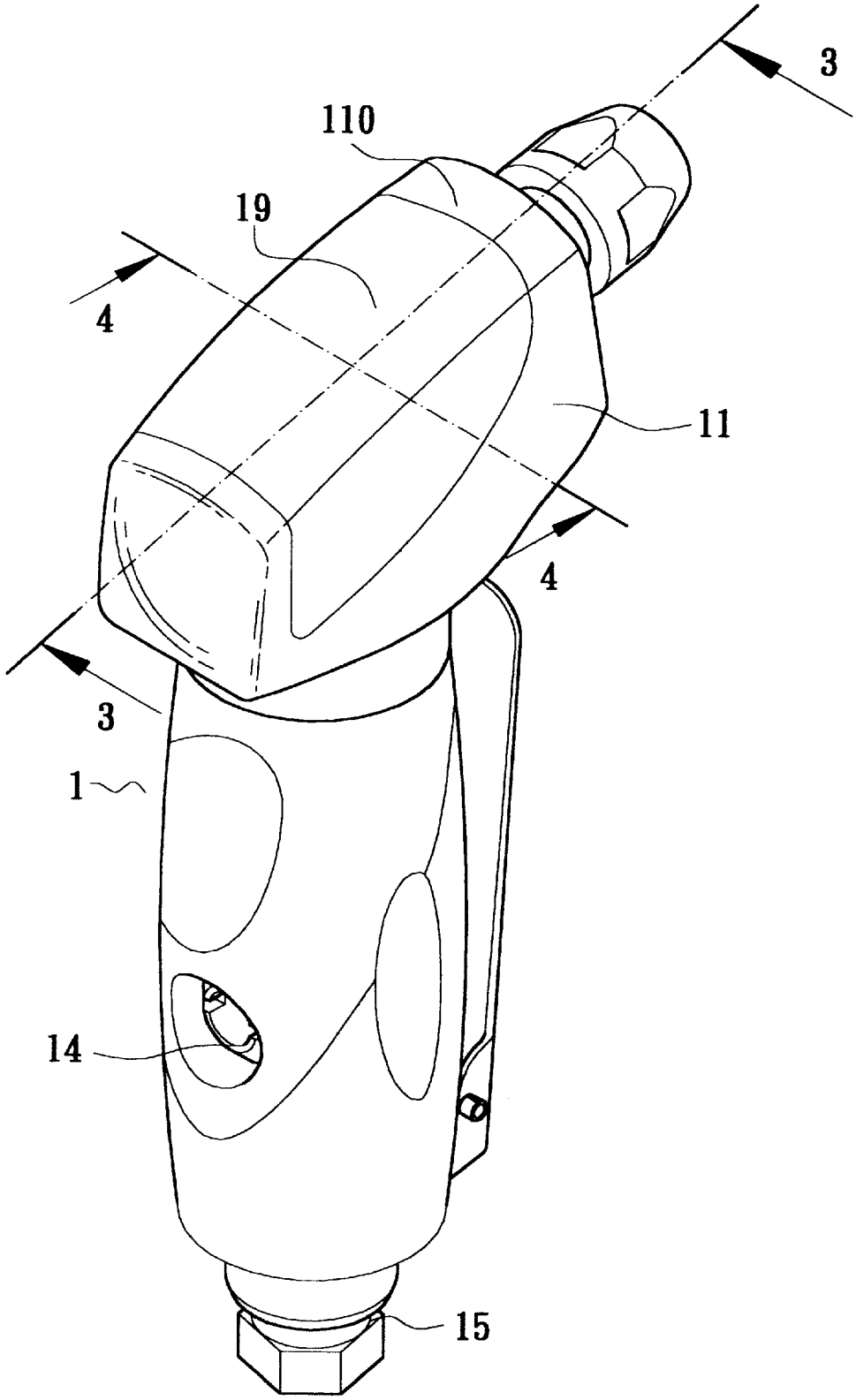
FIG. 1 is a perspective assembled view of the present invention.
Figure 2:
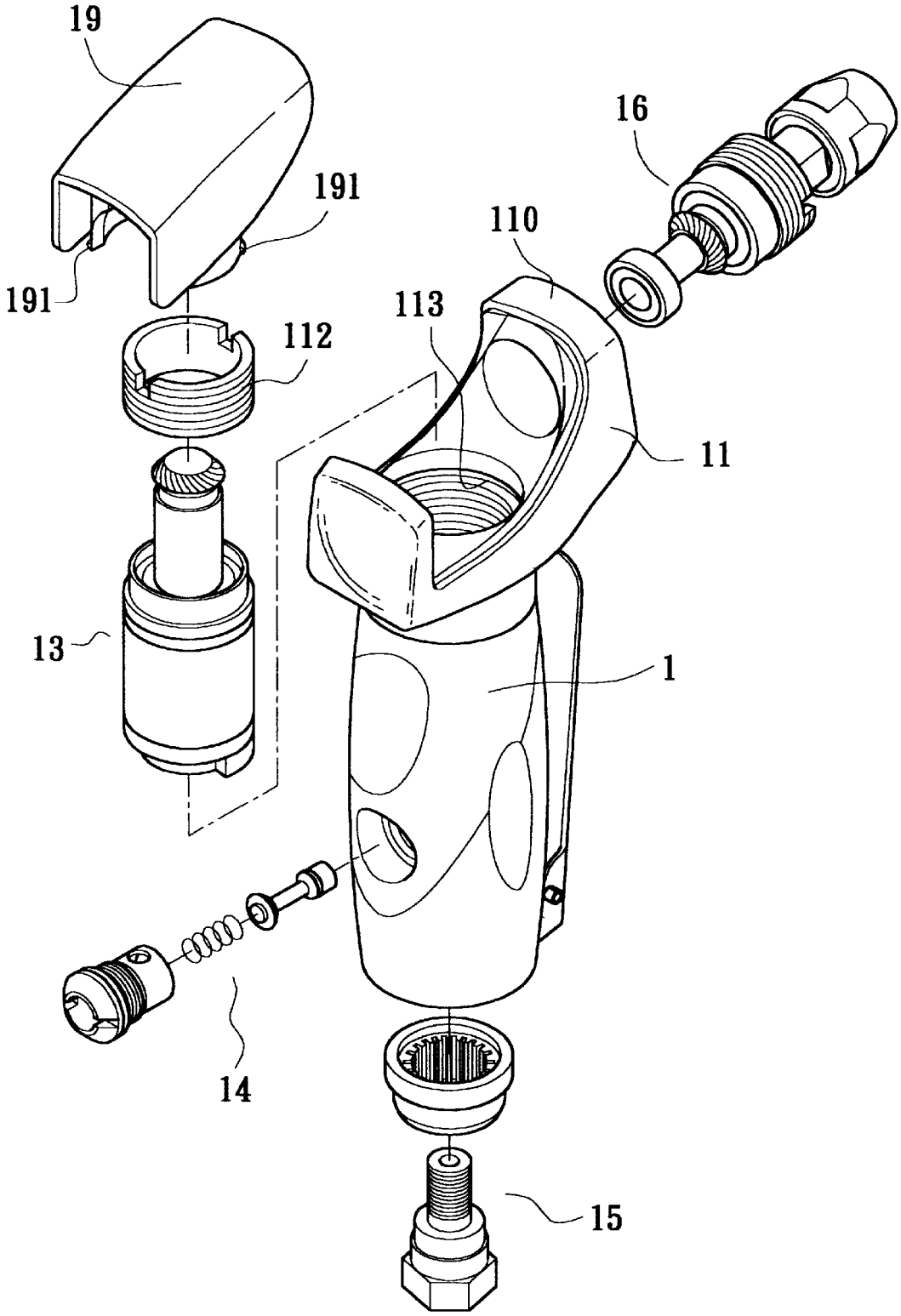
FIG. 2 is a perspective exploded view of the present invention.
Figure 3:
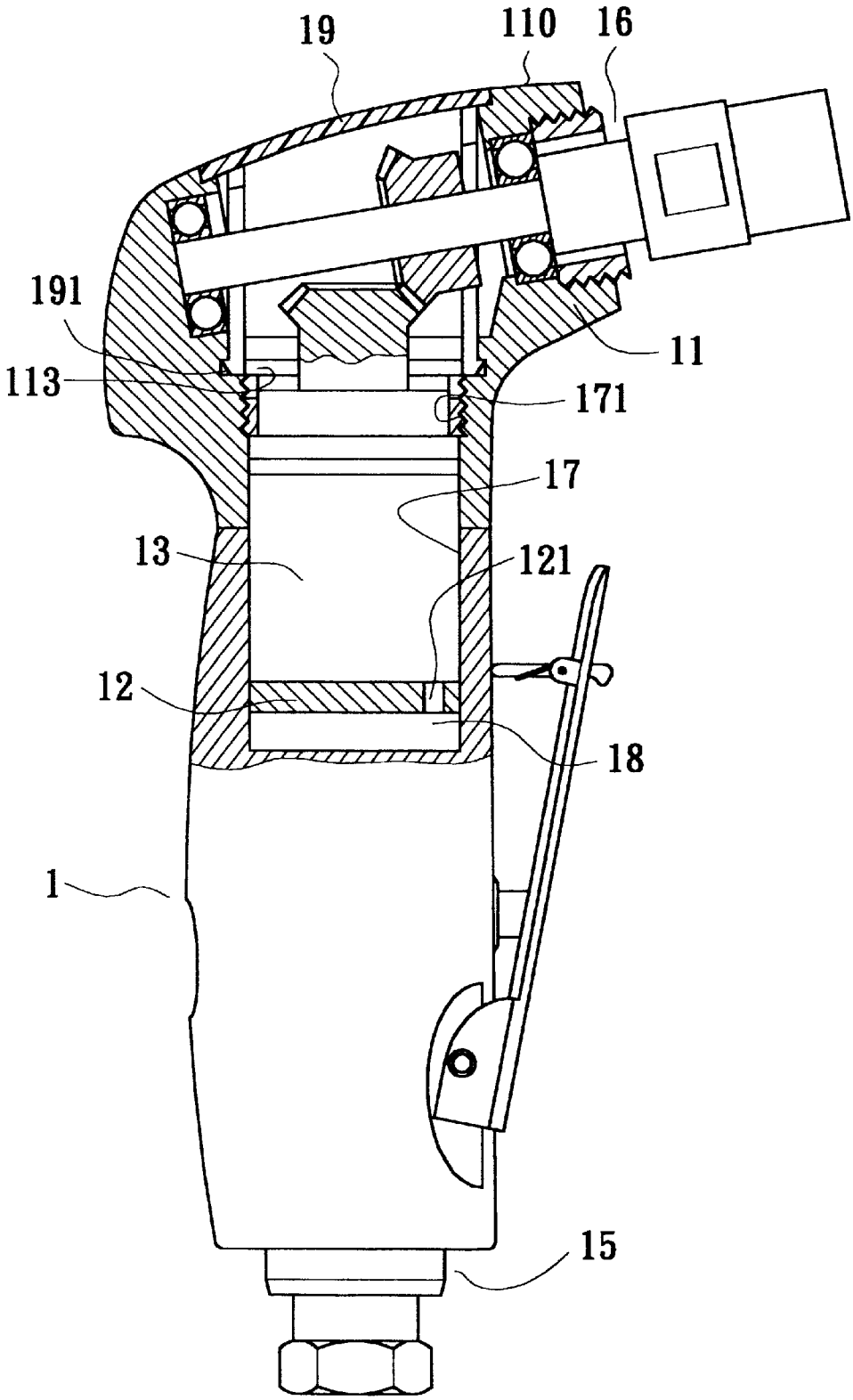
FIG. 3 is a sectional view taken along line 3—3 of FIG. 1.
Figure 4:
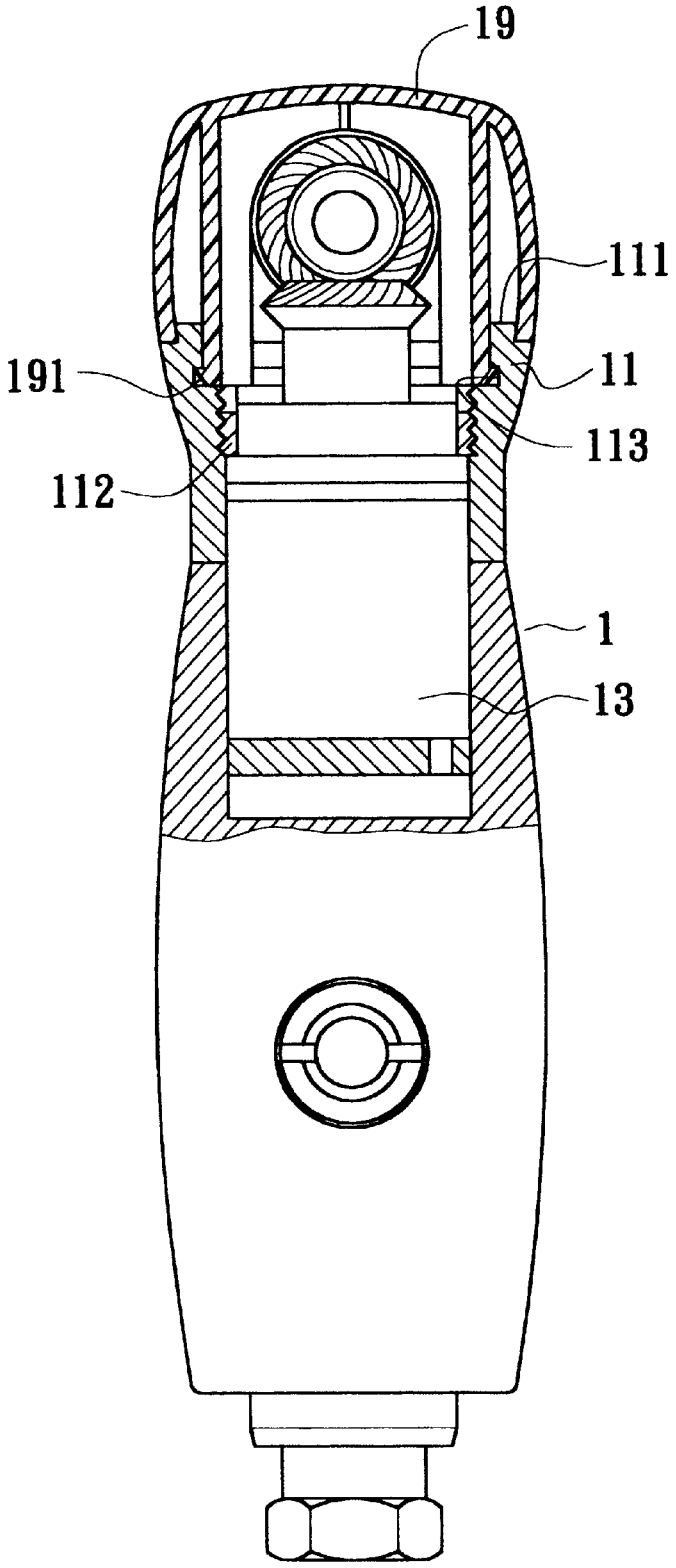
FIG. 4 is a sectional view taken along line 4—4 of FIG. 1.

Please refer to FIGS. 1 and 4. The pneumatic tool of a first embodiment of the present invention includes a main body 1 that is hollow and has an elbow 11 integrally formed on a top portion of the main body 1. A stop section 12 inwardly extends from an inner periphery of the main body 1 to divide the interior thereof into an upper receptacle 17 and a lower receptacle 18. The stop section 12 has a vent 121 defined therein for ventilation. A pneumatic motor 13 is downward disposed into the upper receptacle 17. A switch unit 14 and an intake unit 15 are upwardly disposed into the lower receptacle 18. A driving unit 16 is partially disposed in the elbow 11 and connected to the pneumatic motor 13 and being driven by the pneumatic motor 13. The elbow 11 has a top section 110 formed with an opening 111 corresponding to the main body 1. The pneumatic motor 13 is placed into the upper receptacle 17 from an upper side through the opening 111. The upper portion of the upper receptacle 17 is formed with a threaded section 171. A retainer ring 112 is screwed on the threaded section 171 to fix the pneumatic motor 13 in the upper receptacle 17. A cover 19 is detachably mounted on the elbow 11 for closing the opening 111. The cover 19 has a profile complementary to that of the opening 111. The inner periphery of the opening 111 is formed with an annular groove 113. The bottom of the cover 19 has several ribs 191 corresponding to the annular groove 113, whereby the ribs 191 can be inlaid in the annular groove 113 to fix the cover 19 when the cover 19 closes the opening 111.

When assembled, the switch unit 14 and the intake unit 15 are upwardly installed into the lower receptacle 18. The pneumatic motor 13 is placed into the upper receptacle 17 from the opening 111. The retainer ring 112 is screwed onto the threaded section 171 of the upper receptacle 17 so as to downward press and fix the pneumatic motor 13. Accordingly, the pneumatic motor 13 can be easily and firmly installed in the main body 1. The driving unit 16 is partially mounted in the elbow 11 and connected to the pneumatic 13. Then, a test of a connection between the pneumatic motor 13 and the driving unit 16 can be easily performed by using the opening 19 during assembling the pneumatic tool structure of the present invention. In case of problem, the pneumatic motor 13 and the switch unit 14 and the intake unit 15 can be easily respectively disassembled from the main body 1. After tested, the assembling step only needs to mount the cover 19 on the elbow 11 so that to assemble the pneumatic tool of the present invention is finished.

As described above, the elbow 11 is integrally formed on the top of the main body 1 and the top section of the elbow 11 is formed with the opening 111 corresponding to the main body 1. Consequently, after the switch unit 14 and the intake unit 15 are installed into the main body 1, the pneumatic motor 13 is placed in the upper receptacle 17 via the opening 111 and the retainer ring 112 is screwed onto the threaded portion 171 of the upper receptacle 17 to lock the pneumatic motor 13 such that installation is easy and the test is facilitated.

Figure 5:
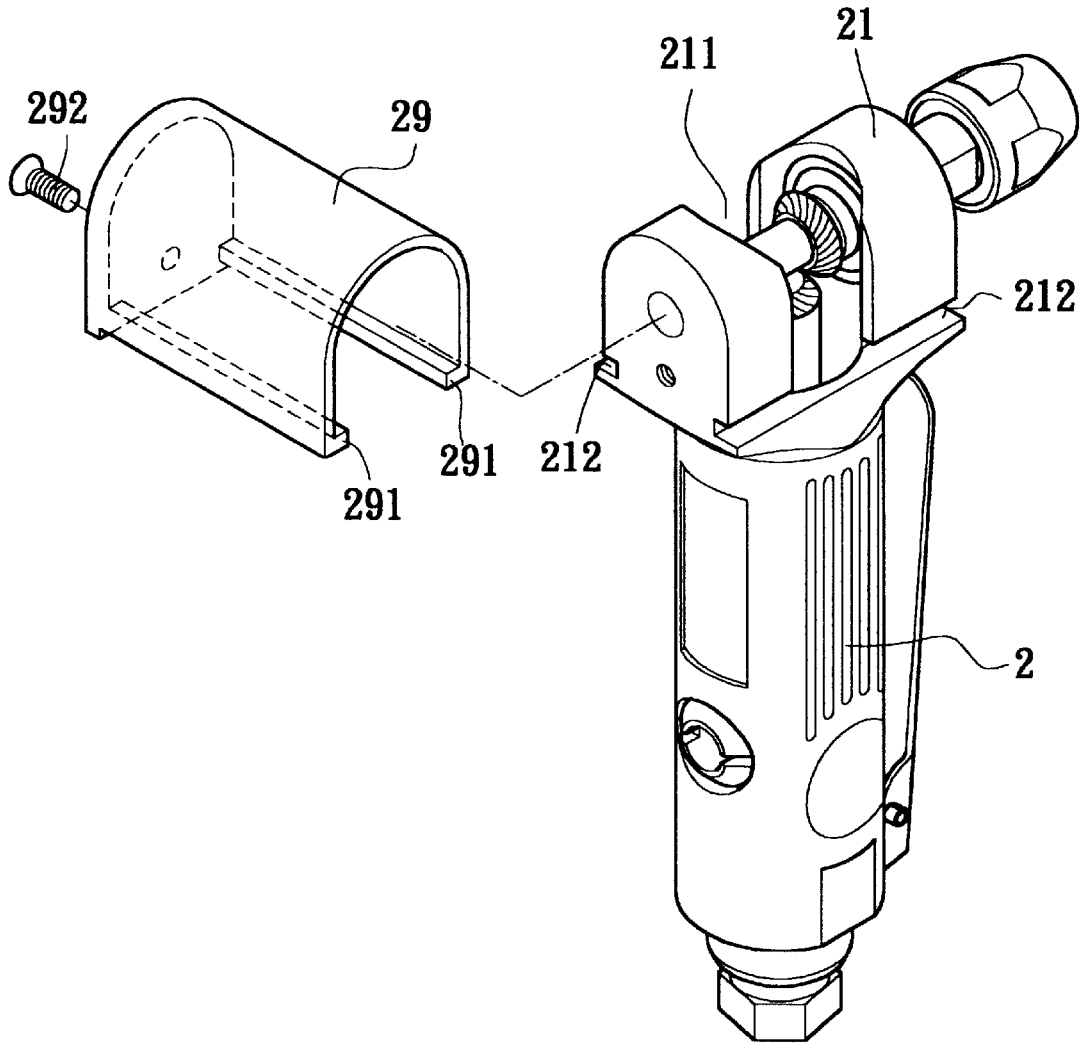
FIG. 5 is a perspective exploded view of a second embodiment of the present invention.
Figure 6:
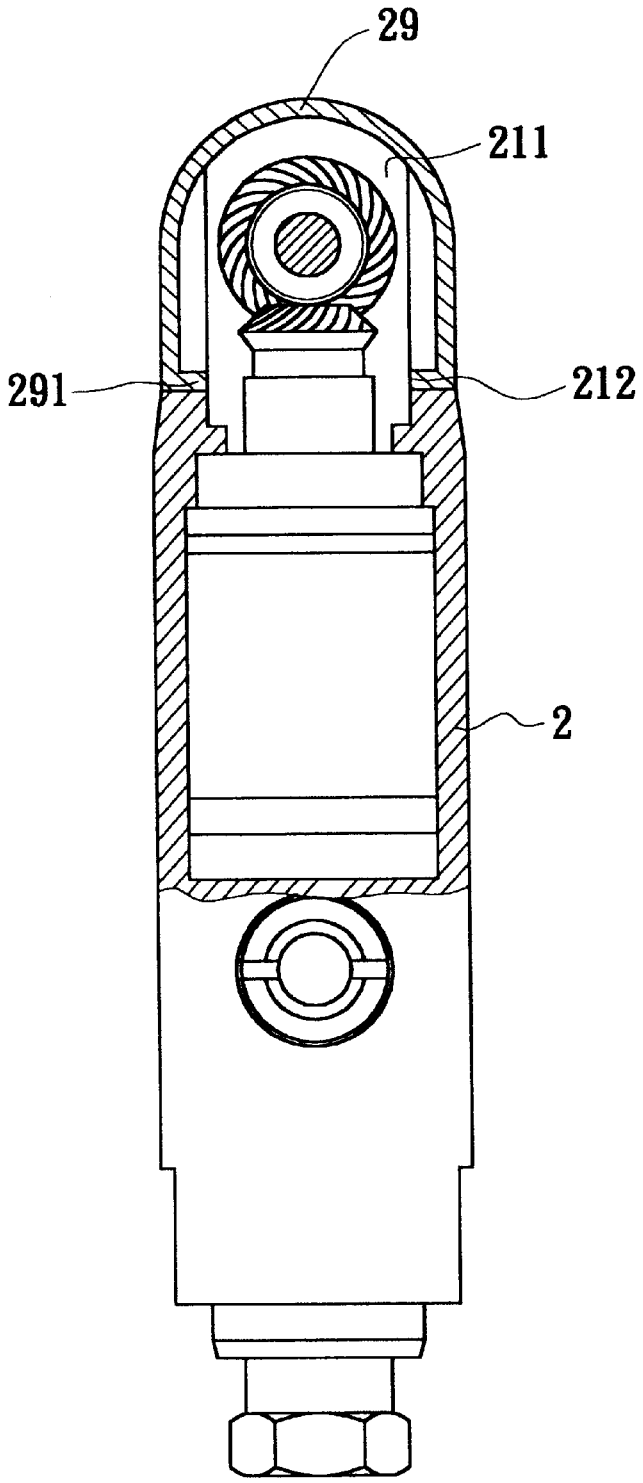
FIG. 6 is a sectional assembled view of the second embodiment of the present invention.
Figure 7:
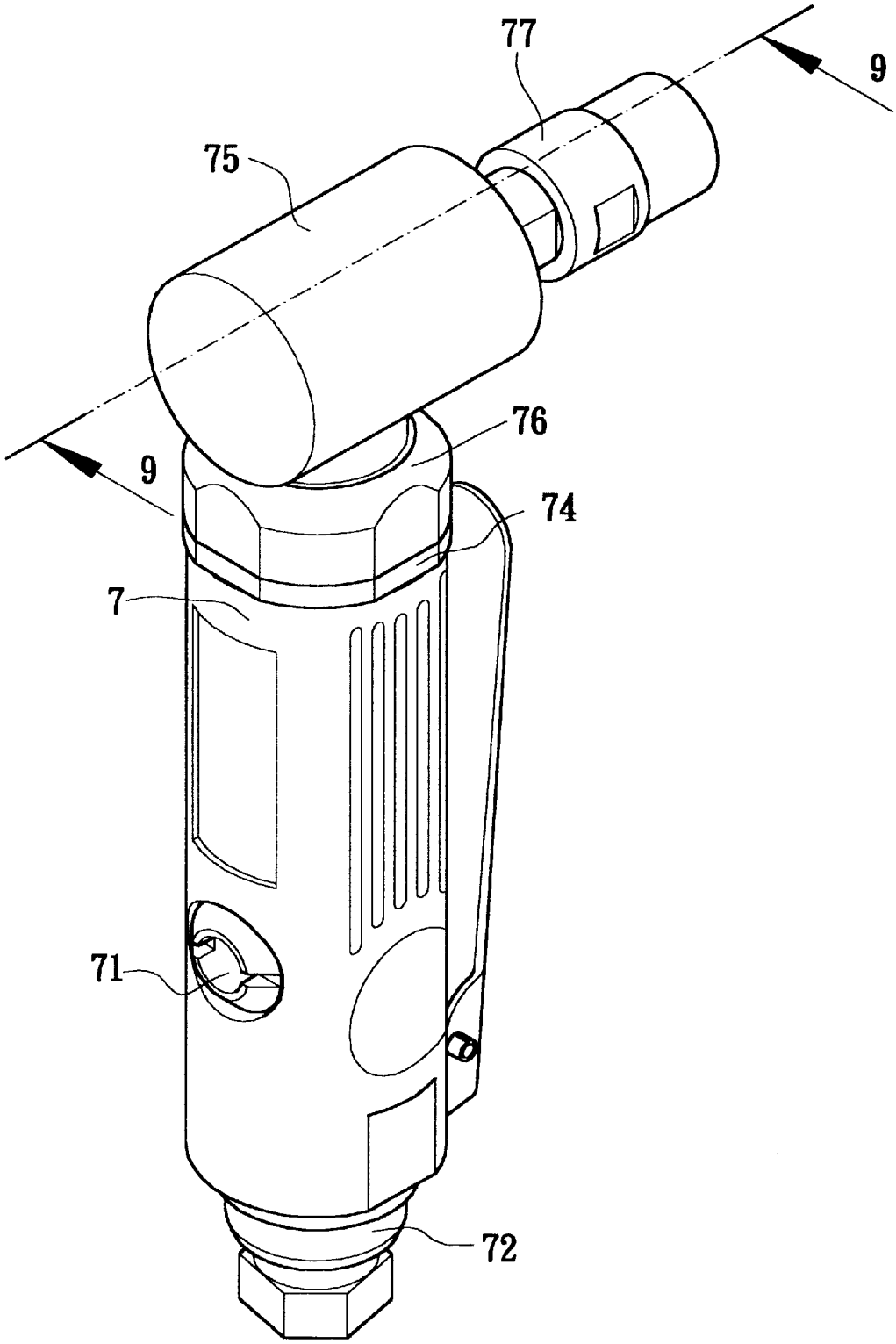
PRIOR ART FIG. 7
FIG. 7 is a perspective assembled view of a conventional pneumatic tool.
Figure 8:
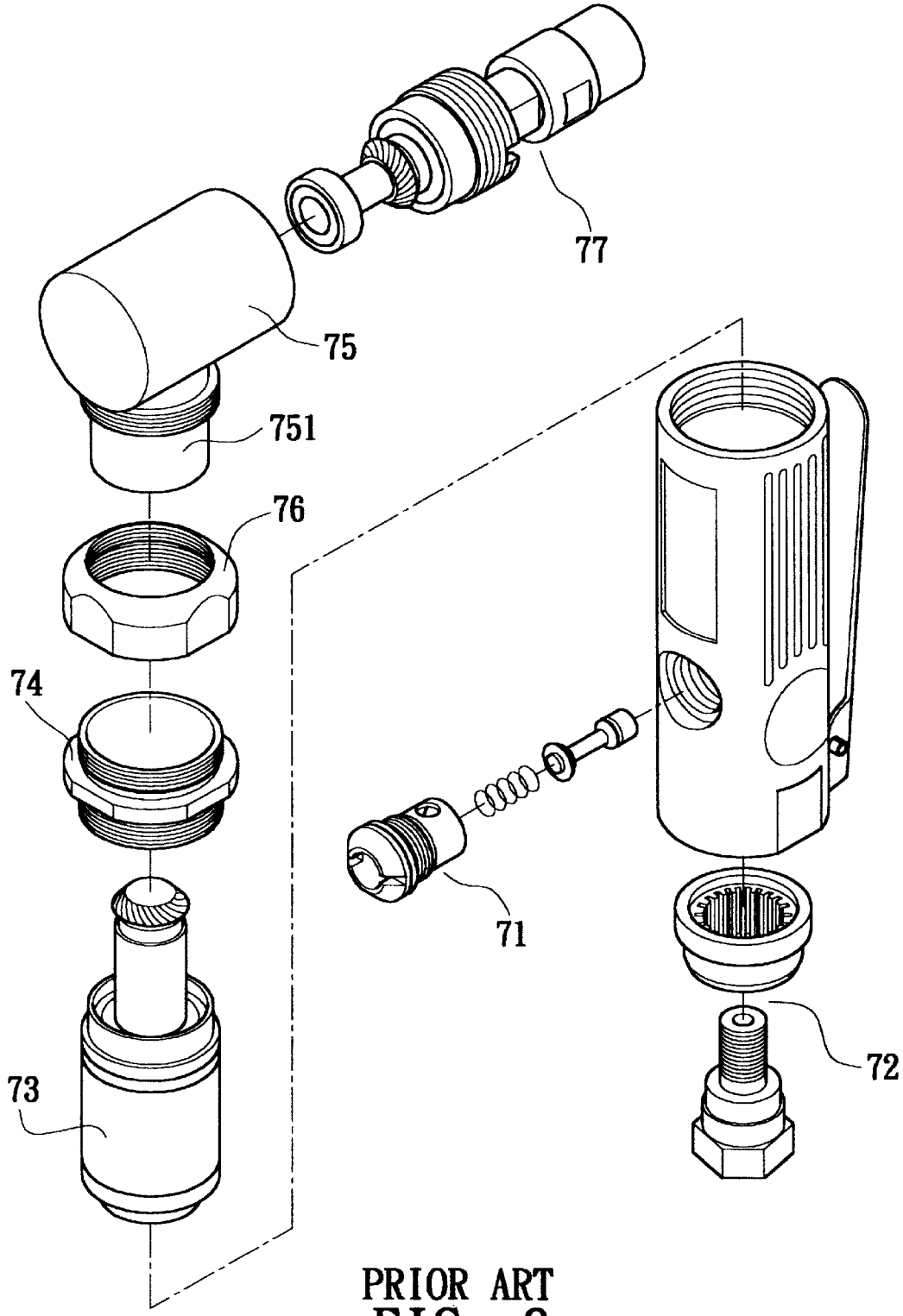
PRIOR ART FIG. 8
FIG. 8 is a perspective exploded view of a conventional pneumatic tool.
Figure 9:
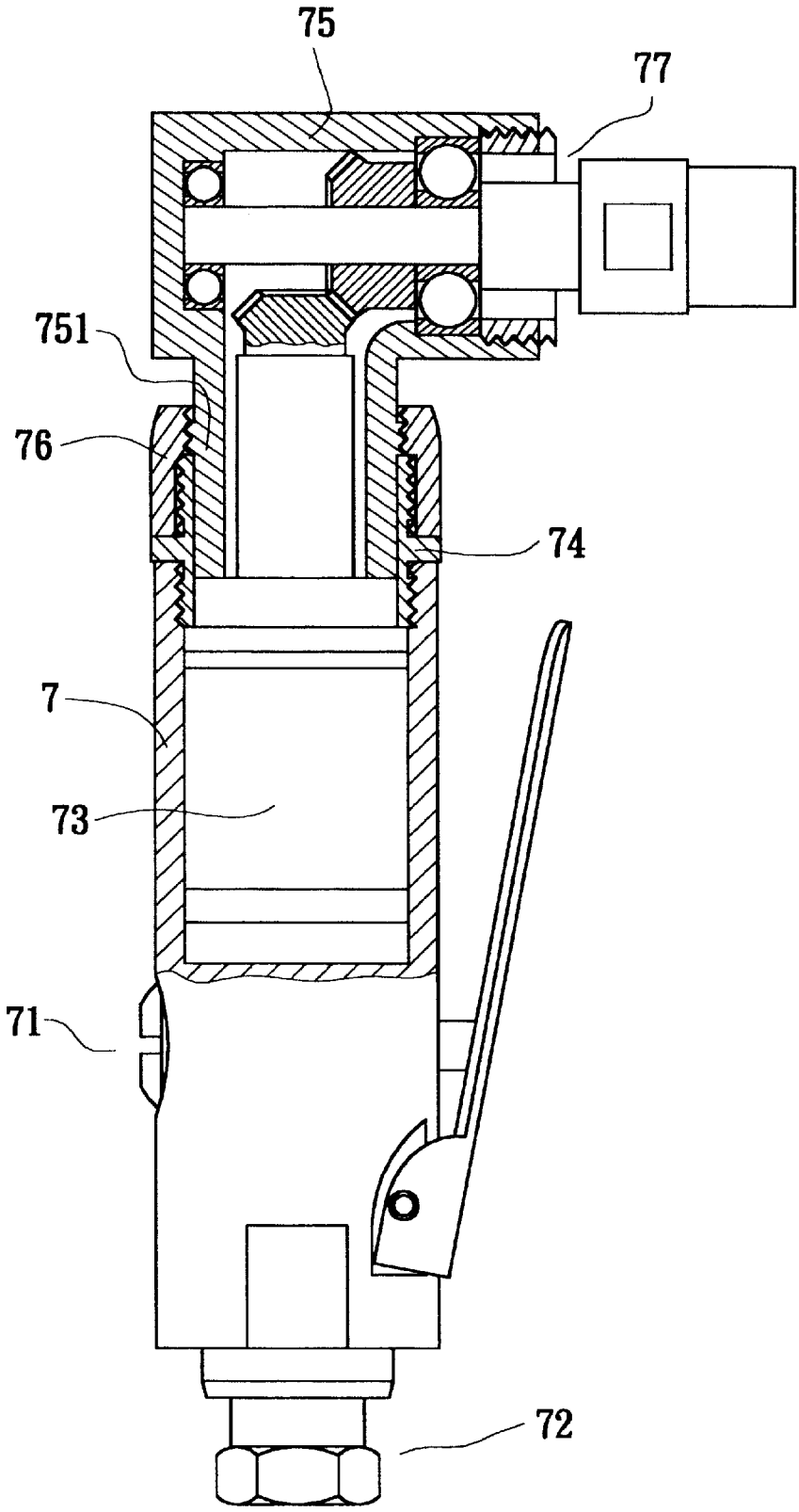
PRIOR ART FIG. 9
FIG. 9 is a sectional view taken along line 9—9 of FIG. 7.
Figure 10:
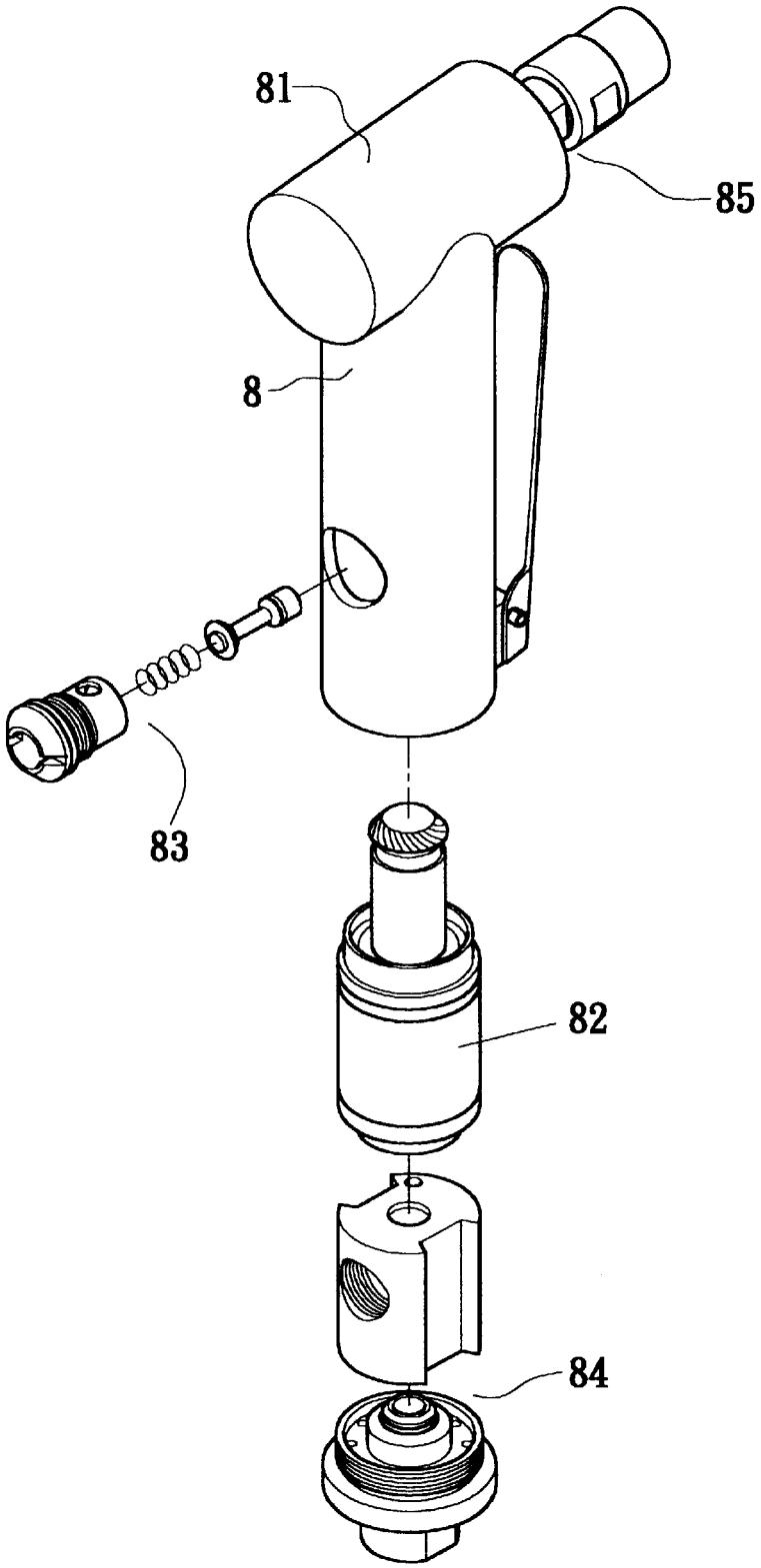
PRIOR ART FIG. 10
FIG. 10 is a perspective exploded view of another type of conventional pneumatic tool.
Figure 11:
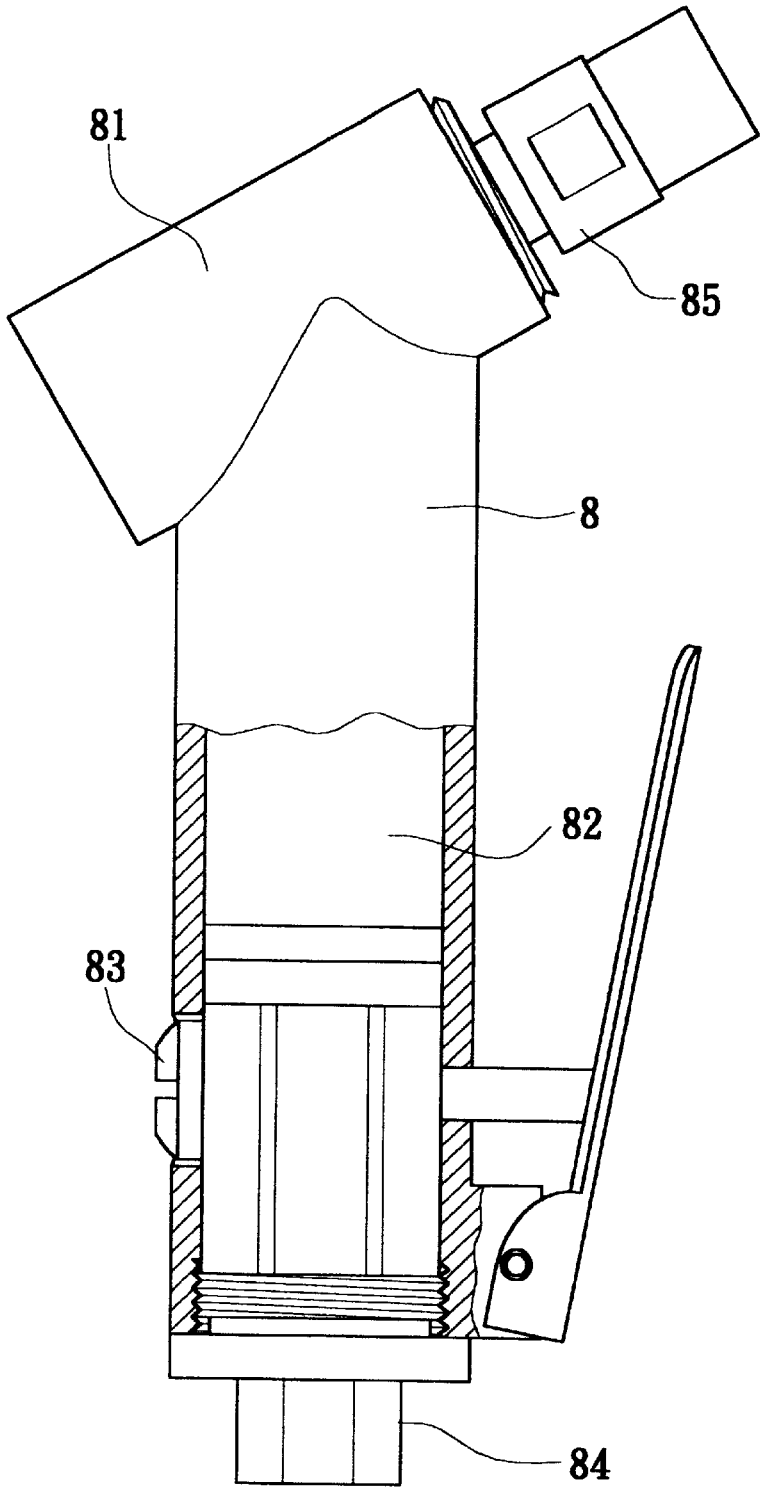
PRIOR ART FIG. 11
FIG. 11 is a sectional assembled view of the other type of conventional pneumatic tool.

The above embodiment is only used to illustrate the present invention, not intended to limit the scope thereof. Many modifications of the above embodiment can be made without departing from the spirit of the present invention. For example, FIGS. 5 and 6 show a second embodiment of the present invention. The cover 29 has a profile complementary to that of the elbow 21. The cover 29 serves to cover the outer of the elbow 21 and close the opening 211. Two opposite lateral sides of the elbow 21 are respectively formed with a corresponding one of the slide channels 212. The cover 29 is formed with two slide rails 291 each inlaid in a corresponding one of the slide channels 212 to fit the cover 29 onto the elbow 21. A bolt 292 is passed through rear side of the cover 29 to lock the cover 29 on the elbow 21. This embodiment can achieve the same effect as the first embodiment.

What is claimed is:

1. A pneumatic tool structure comprising a main body that is hollow and has an elbow integrally formed on a top portion of the main body, a stop section inwardly extending from an inner periphery of the main body to divide the inner periphery of the main body into an upper receptacle and a lower receptacle, a vent defined in the stop section for ventilation, a pneumatic motor securely mounted in the upper receptacle, a switch unit and an intake unit being in the lower receptacle of the main body, a driving unit being disposed in the elbow and connected to the pneumatic motor and being driven by the pneumatic motor, the elbow having a top section formed with an opening corresponding to the main body and formed such that the pneumatic motor is capable of being placed into the main body from the upper side through the opening, thereby facilitating an inspection of a connection between the pneumatic motor and the driving unit by using the opening during assembly of the pneumatic tool structure; said top section having a detachably mounted cover for closing the opening.

2. The pneumatic tool structure as claimed in claim 1, wherein the upper receptacle formed with a threaded section on an upper portion of the upper receptacle, a retainer ring being screwed on the threaded section for fixing the pneumatic motor in the upper receptacle.

3. The pneumatic tool structure as claimed in claim 1, wherein the cover has a profile complementary to that of the opening, an inner periphery of the opening being formed with an annular groove, a bottom of the cover having ribs corresponding to the annular groove, whereby the ribs are inlaid in the annular groove to fix the cover.

4. The pneumatic tool structure as claimed in claim 1, wherein the cover has a profile complementary to that of the elbow, the cover serving to cover outer side of the elbow, two lateral sides of the elbow being respectively formed with two slide channels, the cover being formed with two slide rails corresponding to the slide channels, whereby the slide rails are inlaid in the slide channels to fit the cover onto the elbow, a bolt being passed through rear side of the cover to lock the cover on the elbow.

* * * * *